US005642019A

United States Patent [19]

Sun

[11] Patent Number: 5,642,019

[45] Date of Patent: Jun. 24, 1997

[54] SAFETY PROTECTOR FOR NON-ISOLATED BALLASTS

[75] Inventor: Ning Sun, Fort Wayne, Ind.

[73] Assignee: Magnetek Inc., Nashville, Tenn.

[21] Appl. No.: 539,826

[22] Filed: Oct. 6, 1995

[51] Int. Cl.[6] ..... H05B 37/00

[52] U.S. Cl. ..... 315/244; 315/310; 315/348; 315/126

[58] Field of Search ..... 315/244, 126, 315/209 R, 224, 310, 348, 308, 307

[56] References Cited

U.S. PATENT DOCUMENTS

| | | | |
|---|---|---|---|
| 4,277,726 | 7/1981 | Burke | 315/98 |
| 4,422,056 | 12/1983 | Roberts | 315/239 X |
| 4,427,955 | 1/1984 | Roberts | 315/244 X |
| 4,507,698 | 3/1985 | Nilssen | 361/42 |
| 4,855,860 | 8/1989 | Nilssen | 361/45 |
| 4,888,675 | 12/1989 | Kumar et al. | 363/47 |
| 4,902,942 | 2/1990 | El-Hamamsy | 315/276 |
| 4,943,886 | 7/1990 | Quazi | 315/119 X |
| 5,010,277 | 4/1991 | Courier De Mere | 315/200 R |
| 5,225,741 | 7/1993 | Auld, Jr. et al. | 315/307 |
| 5,313,176 | 5/1994 | Upadhyay | 333/181 |
| 5,449,981 | 9/1995 | Auld, Jr. et al. | 315/308 |
| 5,568,041 | 10/1996 | Hesterman | 323/207 |

OTHER PUBLICATIONS

MTI Ballast MB-232-120-RS-T8M Schematic by Tom Poehlman, Mar. 30, 1995.

*Primary Examiner*—Robert Pascal
*Assistant Examiner*—Haissa Philogene
*Attorney, Agent, or Firm*—Mark P. Bourgeois

[57] ABSTRACT

A protection circuit for non-isolated ballasts that drive gas discharge lamps to prevent shock hazards. The device acts to prevent excessive leakage currents from flowing between the ballast and ground by introducing a higher common mode impedance path in the circuit. A two stage common mode filter assembly has a first common mode inductor series connected to a second common mode inductor. A first capacitor is connected across the common mode inductors. A second capacitor is connected between the junction of the first capacitor, the first inductor, the second inductor and ground. The circuit protects by reducing high frequency leakage currents.

10 Claims, 3 Drawing Sheets

SAFETY PROTECTOR FOR NON-ISOLATED BALLASTS

BACKGROUND OF THE INVENTION

This invention relates to a protection circuit for non-isolated ballasts that drive gas discharge lamps to prevent shock hazards. The device acts to prevent excessive leakage currents from flowing between the ballast and ground by introducing a higher common mode impedance path in the circuit.

In fluorescent lighting fixtures, a high voltage is required at the sockets in order to initially strike the lamp and cause an electrical arc to begin flowing between the electrodes. These high voltages pose a potential shock hazard to service people having to work on the fixtures such as during lamp replacement. To reduce this hazard, protection methods have to be employed whenever the voltages in the fixture exceed a certain level. The main shock hazard situation exists when a repairman is in good contact with earth ground. This can occur in a variety of situations such as when the repairman is holding onto a pipe for support or is working in a damp or wet environment. When one part of the person is in ground contact and is holding onto one end of a fluorescent lamp while the other end is being inserted into a lamp socket, an electrical shock situation can occur.

Two Underwriters Laboratory (UL) tests for shock hazard are required to passed by a lamp ballast to receive UL approval. The first test is called a through lamp leakage current test. See FIG. 3 for a diagram of the test set-up. This test measures the amount of current that will flow through an unstruck lamp with one end in the fixture and the other end connected to ground through a resistor. The current flow is due to the parasitic capacitance that exists between the length of the lamp and ground. Its purpose is to simulate a relamping procedure when a person is holding onto one end of the lamp and inserts the other end into an energized fixture. The second test is called a metal foil leakage current test. This test measures the amount of current that will flow between one end in the fixture and a metal foil placed around the lamp and connected to ground. A metal foil is placed around the lamp, connected to ground and is slid along the length of the lamp to test all positions along the fixture and lamp. While the foil is being moved, the maximum current is recorded. The current flow is due to the parasitic capacitance that exists between the glass wall of the lamp and ground. Its purpose is to simulate a relamping situation when a person is holding the lamp in the middle to remove or insert it into an energized fixture.

Prior attempts at reducing shock hazards have resulted in implementations with various drawbacks. The most common technique is to provide electrical isolation between the power line input, ground and the ballast output at the lamp sockets using a isolation transformer. One such implementation is illustrated by U.S. Pat. No. 4,277,726. This patent shows the isolation transformer providing electrical isolation to prevent leakage currents flowing between the fixture and ground. This solution is safe; however, it involves substantial penalties in terms of cost, size, weight and electrical efficiency. Another prior art technique is illustrated in U.S. Pat. Nos. 4,507,698 and 4,855,860. These patents show using a sensing circuit to detect ground faults or currents. When the ground current flow is detected a circuit is triggered that shuts down the inverter circuit in a ballast thus reducing the voltage at the lamp sockets to zero. This solution is workable, however; it involves substantial penalties in terms of cost, and additional circuit complexity.

Another technique that could be utilized is that of a circuit interrupting socket. Unfortunately, these are a special non-standard socket that are costly and would require extensive wiring to be added to each fixture. Another possible approach is to put a switch on each fixture to turn it off during servicing. This approach would require the extra cost of including a separate switch and its associated wiring in each fixture. Also, a repairman could forget or not bother with unpowering the fixture during lamp replacement thus placing himself in a potentially hazardous situation.

A currently unmet need exists for a simple low cost technique to be incorporated into a non-isolated electronic ballast to prevent shock hazards during servicing.

SUMMARY

A protection circuit for a non-isolated ballast that drives at least one gas discharge lamp to prevent shock hazards. It has a two stage common mode filter assembly which contains input terminals to connect with a source of AC power and a ground. A first common mode inductor is connected to the input terminals and a second common mode inductor series is connected to the first common mode inductor. A first capacitor is parallel connected across the first and the second common mode inductors. A second capacitor is connected between the first capacitor and the ground. It further has output terminals that are connected between the second common mode inductor and the ballast whereby any leakage current flowing between the lamp and ground is reduced to a safe magnitude and shocks are prevented when changing lamps or working on a light fixture.

BRIEF DESCRIPTION OF THE DRAWINGS

These and other features, aspects and advantages of the present invention will become better understood with regard to the following description, appended claims and accompanying drawings where:

DETAILED DESCRIPTION OF THE PREFERRED EMBODIMENTS

Figure 1:
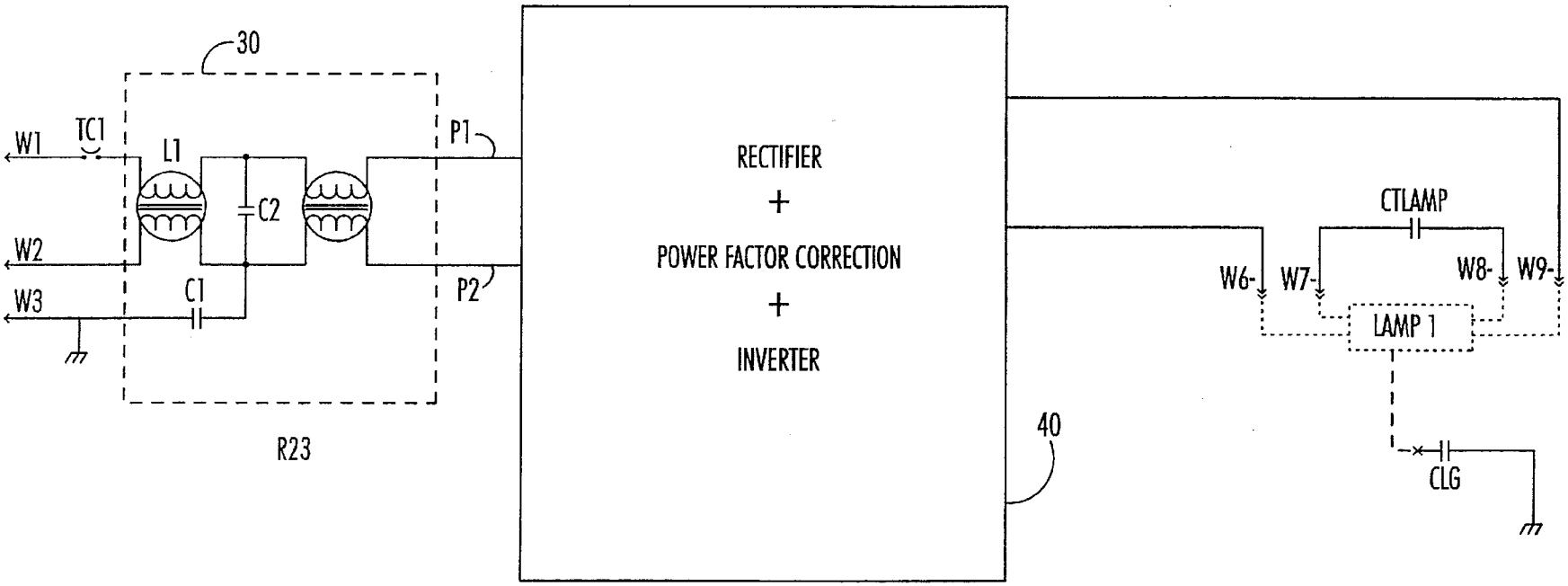
FIG. 1 is a block diagram of the safety protector showing its position in a electronic ballast.

FIG. 1 shows a block diagram of the safety protector with a ballast and a lamp. This device prevents shocks from occurring by reducing the amount of current that will flow external to the circuit by creating a higher impedance in the common mode path.

Referring to FIG. 1, a two stage common mode filter assembly 30 is connected to input terminals W1, W2 and W3. W1 and W2 are connected to the AC supply. W3 is connected to ground. A block 40 is shown which contains a rectifier, power factor correction and an inverter. These make up the primary components in an electronic ballast. The lamp 1 is powered by connection to the output of the inverter. A parasitic capacitance, Clg is shown between the lamp and ground. This capacitance is shown to represent the capacitance between the glass wall and ground. Another parasitic capacitance, Ctlamp is shown. This capacitance represents the capacitance through the lamp.

Two stage common mode filter assembly 30 has a common mode inductor L1 which is connected to input terminals W1 and W2. Inductor L1 is series connected to another common mode inductor L2. A capacitor C2 is connected across the common mode inductors. A capacitor C1 is connected between the junction of C2, L1, L2 and ground. The output of assembly 30 is fed into the rectifier, power factor correction and inverter assembly 40 on terminals P1 and P2. Inductor L1 preferably has a value between 10 and 80 millihenries for optimum operation. Inductor L2 preferably has a value between 3 and 40 millihenries for optimum operation. Capacitor C1 preferably has a value between 0.25 and 1.5 nanofarads for optimum operation. Capacitor C2 preferably has a value between 0.05 and 0.2 microfarads for optimum operation.

The operaion of the safety protector is as follows. Leakage currents are caused by the lamp to ground parasitic capacitances. The amplitude of leakage current is determined by the ballast open circuit voltage, the common mode path impedance as well as the lamp parasitic capacitance and input sixty cycle voltage. The two stage common mode inductors make the common mode path impedance much larger. Any leakage currents flowing have to pass through this impedance and are significantly reduced. Experimental results show that better results are obtained when L1 is higher than L2. The combination of L2 and C1 has a higher resonant frequency which will block higher frequency leakage currents. L1 and C1 will have a lower resonant frequency and will be effective to block noise on the 60 Hz AC line.

Figure 2:
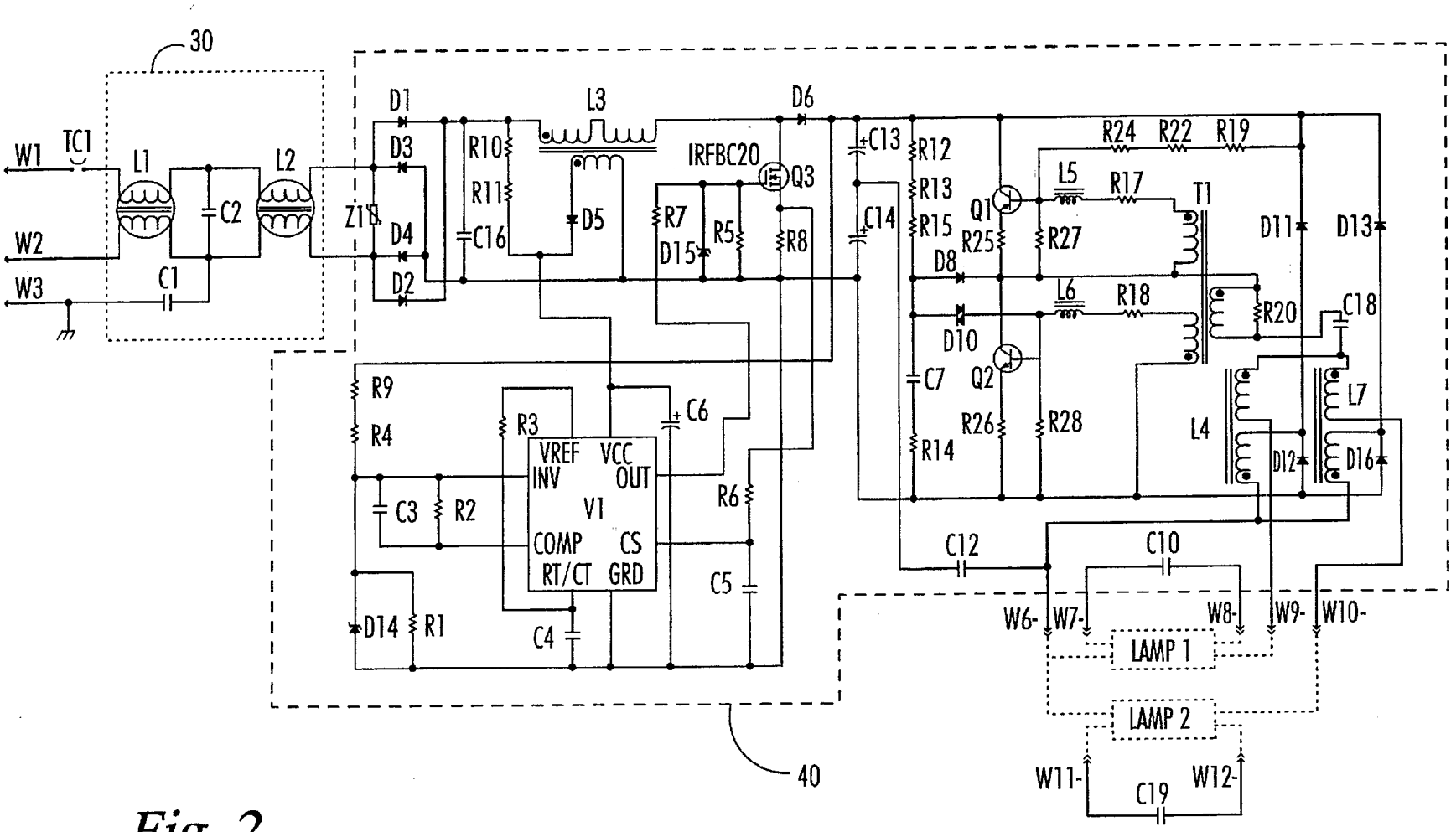
FIG. 2 is a schematic diagram of a preferred embodiment of the safety protector in a electronic ballast.

FIG. 2 shows a two stage common mode filter assembly 30 along with a possible implementation of an electronic ballast as shown in block 40. Its operation will be briefly described. Diodes D1 through D4 rectify the filtered AC voltage. Inductor L3 and boost switch Q3 boost the DC voltage to a level higher than the AC input level. Integrated circuit U1 is a power factor correction integrated circuit and controls the switching of Q3. Transistors Q1 and Q2 convert the DC voltage to a high frequency AC which then causes a resonant circuit of L4, L7, C12 and C18 to drive Lamp 1 and Lamp 2.

Figure 3:
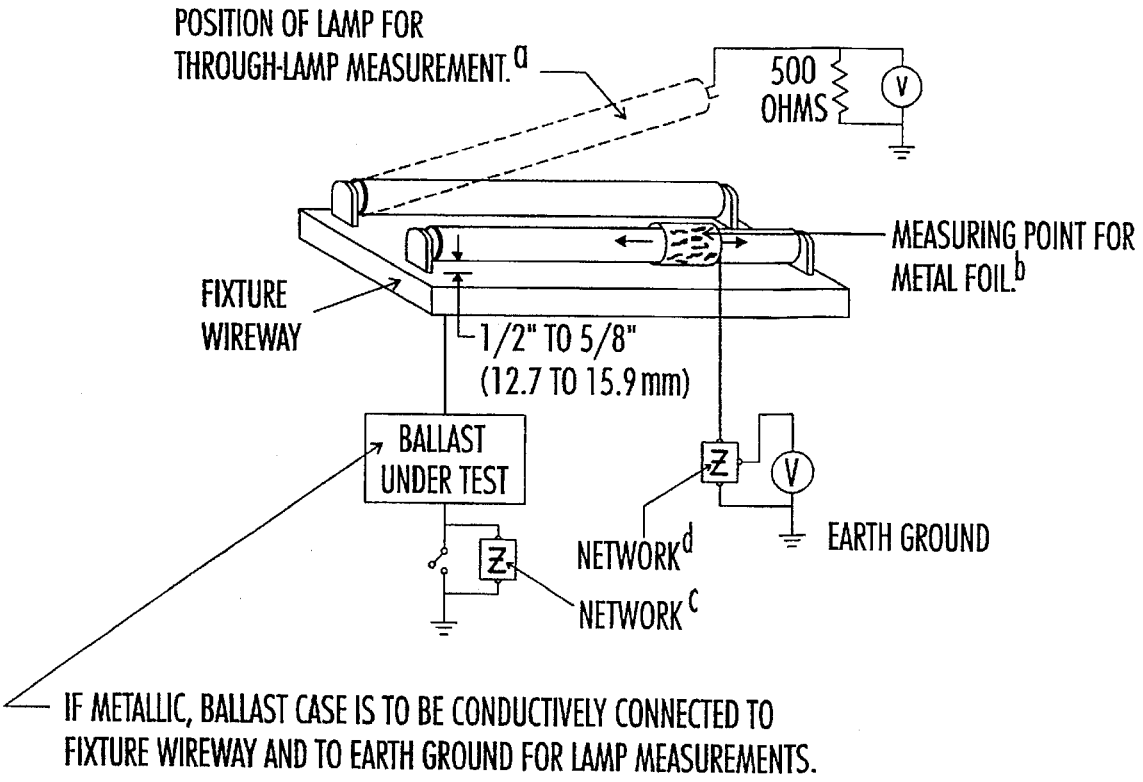
FIG. 3 is a diagram of a UL test set-up for measuring leakage and shock currents.

Referring to FIG. 3, a diagram of the leakage current test set-up is shown. Two Underwriters Laboratory (UL) tests for shock hazard are required to passed by a lamp ballast to receive UL approval. The first test is called a through lamp leakage current test. This test measures the amount of current that will flow through an unstruck lamp with one end in the fixture and the other end connected to ground through a resistor. The requirement to pass the test is a maximum of 43.45 milliamps peak current for a ballast operating at a frequency of 10 Khz or higher. The ballast of the present invention operates at approximately 30 Khz. Experimental test results showed a current of 150 milliamps without the protection circuit and 6 milliamps with the protection circuit. The second test is called a metal foil leakage current test. This test measures the amount of current that will flow between one end in the fixture and a metal foil placed around the lamp and connected to ground. The metal foil is placed around the lamp, connected to ground and is slid along the length of the lamp to test all positions along the fixture and lamp. While the foil is being moved, the maximum current is recorded. The requirement to pass this test is a maximum of 40 millivolts RMS on a voltmeter for a ballast operating at any frequency. Experimental test results showed a voltage of 30 millivolts without the protection circuit and 15 millivolts with the protection circuit. With the protection circuit thus included UL approval is viable.

The present invention has been described in connection with a preferred embodiment. It will be understood that many modifications and variations will be readily apparent to those of ordinary skill in the art without departing from the spirit or scope of the invention and that the invention is not to be taken as limited to all of the details herein. Therefore, it is manifestly intended that this invention be limited only by the claims and the equivalents thereof.

What is claimed is:

1. A protection circuit for a non-isolated ballast that drives at least one gas discharge lamp comprising:

power input terminal means to connect the protection circuit to a source of AC power and to a ground;

the power input terminal means electrically connected to a first common mode inductor having first and second inductor output terminals;

a second common mode inductor having first and second inductor input terminals electrically connected to the first and second inductor output terminals respectively, such that the second common mode inductor is series connected to the first common mode conductor;

a first capacitor electrically connected across the first and second inductor output terminals;

a second capacitor electrically connected between the second inductor output terminal and the ground;

the second common mode inductor having a protection circuit output terminal means for electrically connecting the protection circuit to the ballast; and the second common mode inductor and the second capacitor forming a high frequency filter circuit to reduce high frequency leakage current flowing between the lamp and the ground to a safe magnitude.

2. The protection circuit of claim 1, wherein the first common mode inductor has a inductance between 10 and 80 millihenries.

3. The protection circuit of claim 1, wherein the second common mode inductor has a inductance between 3 and 20 millihenries.

4. The protection circuit of claim 1, wherein the first capacitor has a capacitance between 0.25 and 1.5 nanofarads.

5. The protection circuit of claim 1, wherein the second capacitor has a capacitance between 0.05 and 0.2 microfarads.

6. A two stage common mode filter assembly for reducing the magnitude of a leakage current flowing between a non-isolated ballast, at least one gas discharge lamp and a ground comprising:

power input terminal means to connect the assembly to a source of AC power and to a ground;

a first common mode filter stage, the first common mode filter stage having a first common mode inductor connected to the power input terminals means, the first common mode inductor having first and second inductor output terminals, the first common mode filter stage further having a first capacitor connected between the first and second inductor output terminals;

a second common mode filter stage, the second common mode filter stage having a second common mode inductor, the second common mode inductor having first and second inductor input terminals electrically connected to the first and second inductor output terminals respectively, such that the second common mode inductor is series connected to the first common mode inductor, the second common mode filter stage further having a second capacitor connected between the second input terminal and the ground;

the first common mode filter stage and the second common mode filter stage functioning such that the leakage current flowing between the lamp and ground is reduced to a safe magnitude.

7. The filter assembly of claim 6, wherein the first common mode inductor has a inductance between 10 and 80 millihenries.

8. The filter assembly of claim 6, wherein the second common mode inductor has a inductance between 3 and 20 millihenries.

9. The filter assembly of claim 6, wherein the first capacitor has a capacitance between 0.25 and 1.5 nanofarads.

10. The filter assembly of claim 6, wherein the second capacitor has a capacitance between 0.05 and 0.2 microfarads.

* * * * *